United States Patent [19]

Beck, Jr. et al.

[11] Patent Number: 4,522,460

[45] Date of Patent: Jun. 11, 1985

[54] CONNECTING MEANS FOR CLOSELY SPACED CONDUCTORS

[75] Inventors: Hoy S. Beck, Jr., Lexington; John R. Shoemaker, Reidsville, both of N.C.

[73] Assignee: AMP Incorporated, Harrisburg, Pa.

[21] Appl. No.: 561,858

[22] Filed: Dec. 15, 1983

[51] Int. Cl.[3] ..... H01R 13/39

[52] U.S. Cl. ..... 339/99 R; 339/97 C

[58] Field of Search ..... 339/95 R, 97 R, 97 C, 339/97 P, 98, 99 R, 276 R, 276 T

[56] References Cited

U.S. PATENT DOCUMENTS

| | | | |
|---|---|---|---|
| 3,825,881 | 7/1974 | Wigby . | |
| 3,932,018 | 1/1976 | Parsons et al. . | |
| 3,937,549 | 2/1976 | Hughes | 339/276 T |
| 4,258,973 | 3/1981 | Reynolds et al. . | |

*Primary Examiner*—Joseph H. McGlynn

*Attorney, Agent, or Firm*—Katherine A. Nelson

[57] ABSTRACT

A preloaded electrical connecting device for use with closely spaced elongated conductors which lie essentially in the same plane is disclosed. The device is comprised of an insulated housing having a plurality of contact terminal receiving cavities therein and having one or more electrical contact terminals therein. The terminal is a flat one piece stamped sheet metal member having elongated connector means at one end. The connecting means has first and second jaw members and a throat portion. The jaw members have spaced apart free ends. In the assembled device, a portion of the free end of the first jaw member extends outwardly from the housing. Upon placing the conductor between the first and second jaw members and applying a deforming force to the free end of the first jaw member, the portion is moved into the housing until the end is flush with the housing. As the jaw portion moved into the housing, the jaw member is moved into clamping engagement with the conductor and the second jaw member.

6 Claims, 8 Drawing Figures

CONNECTING MEANS FOR CLOSELY SPACED CONDUCTORS

FIELD OF THE INVENTION

The present invention generally relates to electrical connecting devices and more particularly, is concerned with connectors that are used with closely spaced conductors which lie essentially in the same plane.

BACKGROUND OF THE INVENTION

There is a continuing desire in the electrical and electronics industry to reduce the the size of electrical components and electronic equipment. There is, therefore, an increasing tendency to use cables having relatively small conductors on closely spaced centers. Cables having conductors located on centers which are 0.050 inches (1.27 mm) apart are commonly used. Cables having conductors located on centers which are 0.025 inches (0.63 mm) and closer are being developed.

While soldering and laser welding techniques can be used to terminate closely spaced conductors, these means are relatively expensive. There is an increasing need, therefore, for electrical connecting devices which can be mass terminated to closely spaced conductors, particularly those which lie essentially in the same plane. The invention disclosed herein is one such device. The device is intended for use with conductors which are contained within an insulating sheath, such as flat flexible cable and ribbon cable and with conductors that have been deposited on the surface of an insulating substrate, such as conductive ink and etched traces on membrane or printed circuit boards.

The device is comprised of an insulating housing and one or more contact terminals therein. The housing has an elongated conductor receiving face, an oppositely facing conductor entry face, oppositely facing parallel sidewalls, and oppositely facing parallel endwalls extending between the faces. The housing further has contact receiving cavities extending between the faces, the cavities being essentially parallel to the sidewalls. The elongated conductor receiving face has a conductor carrier receiving slot. The slot is essentially parallel to the endwalls and extends rearwardly into the housing from the receiving face and the terminal conductor carrier. The terminal conductor carrier includes members in which the conductors are surrounded by an insulating sheath as well as members which the conductors have been deposited on, an essentially planar insulating substrate, the upper surface of the conductors being free of insulation.

Each contact terminal is a flat one piece stamped sheet metal member having an elongated conductor connector means at one end. The connecting means has first and second jaw members and a throat portion. The jaw members have free ends and fixed ends. The fixed ends are spaced from each other and attached to the throat portion. The free ends are spaced from each other and movable toward each other.

The free end of the first jaw member further has a portion that extends outwardly from the elongated conductor receiving face of the housing.

After inserting a conductor between the first and second jaw members, the terminal is applied to the conductor by applying a deforming force to the free end of the first jaw member. The outwardly extending portion of the first jaw member moves into the housing until the portion is flush with the front face. Concomitantly, the first jaw member moves into clamping engagement with the elongated conductor and the second jaw member, thus establishing electrical contact with the conductor.

The device as disclosed herein requires a relatively low deforming force to crimp the terminal onto the conductor. The device may be applied using simple hand tools, such as a pair of pliers.

The advantages and other features of this invention will become more apparent through reference to the following description and drawings.

DESCRIPTION OF THE DRAWINGS

FIG. 3 is a view similar to FIGS. 1 and 2 with contact terminals exploded from the housing.

PERFERRED EMBODIMENT OF THE INVENTION

Figure 1:
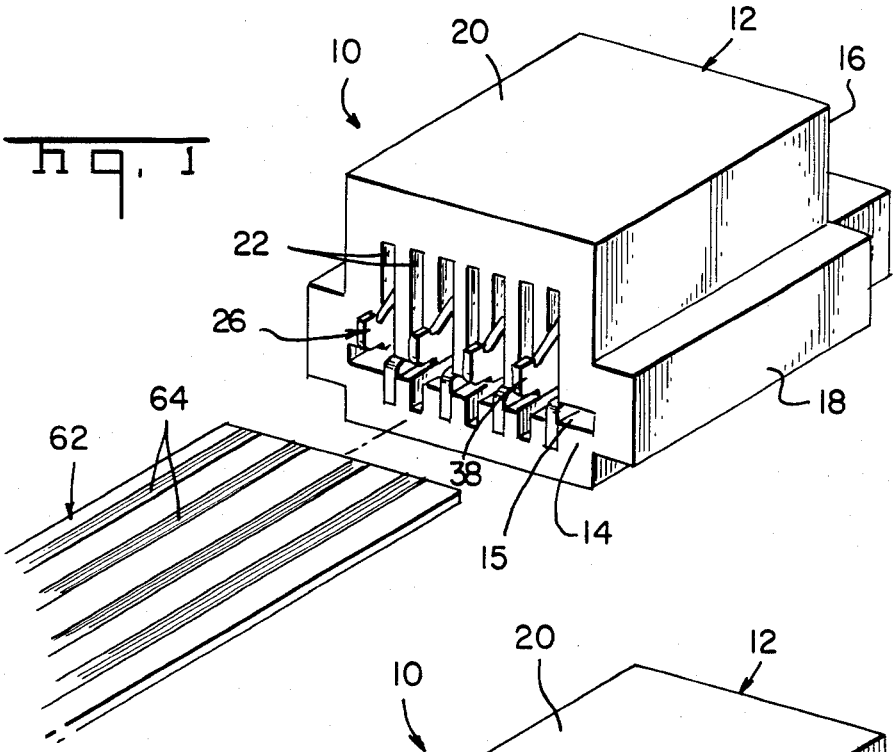
FIG. 1 is a three dimensional view of the preloaded electrical connecting device.
Figure 2:
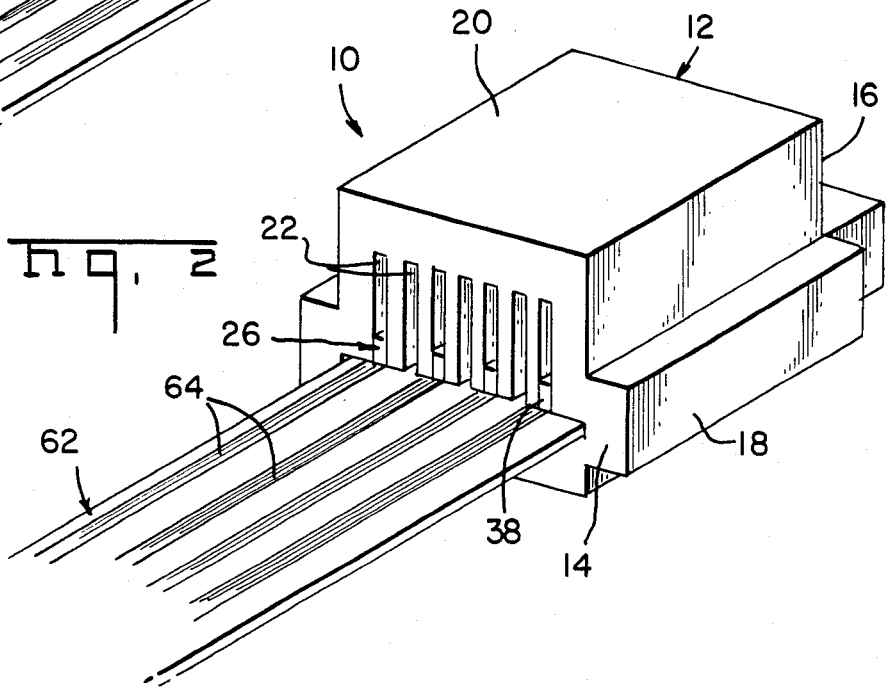
FIG. 2 is a view similar to FIG. 1 having a cable inserted into the device and the contacts terminated.

Referring now to FIGS. 1 and 2, a preloaded electrical connecting device 10 is comprised of an insulating housing 12 having one or more electrical contact terminals 26 therein. The housing has an elongated conductor receiving face 14, a conductor entry face 16, oppositely facing parallel sidewalls 18 and oppositely facing parallel endwalls 20. The sidewalls 18 and the endwalls 20 extend between the faces 14 and 16. The housing 12 has a plurality of terminal receiving cavities 22 which extend through the housing from the elongated conductor receiving face 14 to the conductor entry face 16. At least one of these cavities 22 has a terminal 26 therein.

The housing 12 has a conductor carrier receiving slot 15 which extends rearwardly into the housing 12 from the elongated conductor receiving face. The slot 15 is essentially parallel to the endwalls 20. The conductor carrier 62 is an essentially planar surface which supports at least one elongated conductor 64. The carrier 62 may be an insulating sheath surrounding the conductors 64. This type includes, inter alia, flat flexible cable and ribbon cable. The carrier 62 may be an insulating substrate having conductors thereon, with the upper surface of the conductors being free of insulation.

As is shown in FIG. 1, a portion 38 of the terminal 26 extends beyond the elongated conductor receiving face 14 in the preloaded connector 10. When using the device, the conductor carrier 62 with conductors 64 is inserted into the conductor carrier receiving slot 15. FIG. 2 shows the device after the contact terminals have been terminated. Portion 38 of the terminals is moved into the housing during the termination so that the end of the portion 38 becomes flush with the elongated carrier receiving face 14.

Figure 4:
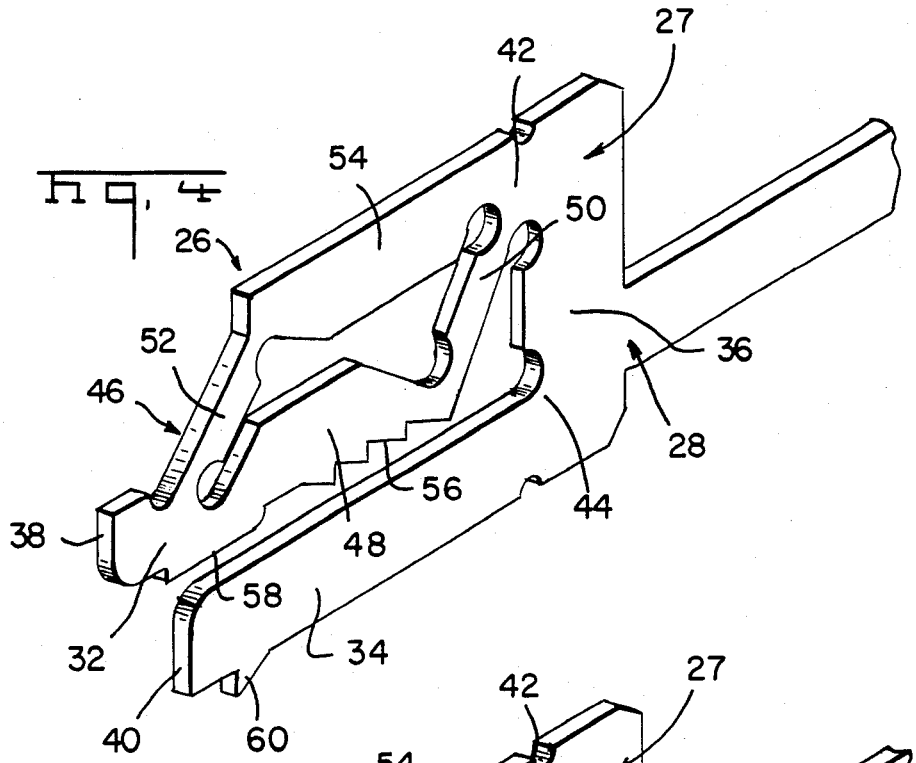
FIG. 4 is an enlarged three dimensional view of the contact terminal prior to insertion of a conductor.
Figure 5:
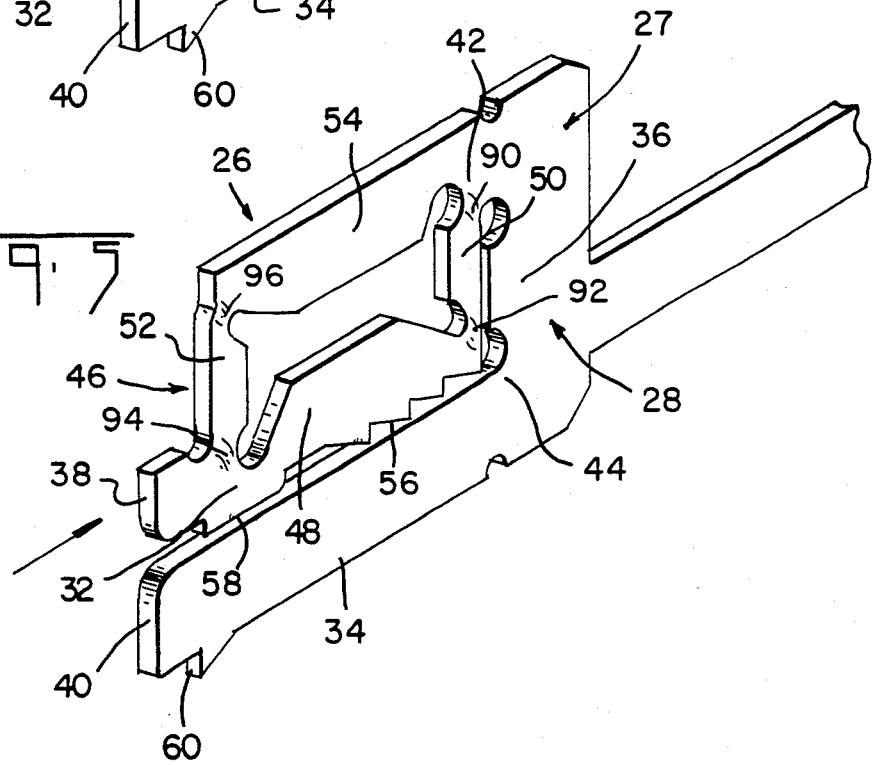
FIG. 5 is an enlarged three dimensional view of the terminal after it has been crimped.

Referring now to FIGS. 3, 4, and 5, the contact terminal 26 is a flat, stamped one piece sheet metal member. At one end of the terminal is the connecting means 27 for elongated conductors 64 that is the subject of the present invention. Numerous other connecting means can be stamped at the other end of the terminal depending upon the type of conductor that is to be connected with the elongated conductors 64. For purposes of clarity, the connector at the other end of the terminal is not illustrated. Some connector types that can be used include tuning fork type receptacles, rectangular and square pins or posts, and leaf type cantilevered beam receptacles.

As is shown in FIGS. 3, 4, and 5, the connecting means 27 has first and second jaw members 32, 34 and a throat portion 36. The jaw members 32, 34 have free ends 38, 40 and fixed ends 42, 44 respectively. The fixed ends 42, 44 are spaced from each other and are attached to the throat portion 36. The jaw members 32, 34 and the throat portion 36 are all in a common plane.

The first jaw member 32 is comprised of a four bar linkage mechanism 46. The linkage mechanism 46 is comprised of a connecting link 48, first and second crank links 50, 52 and a fixed link 54. The connecting link 48 and the fixed link 54 extend essentially parallel to the second jaw member 34. The crank links 50, 52 join the connecting and fixed links and extend diagonally away from the ends of the connecting and fixed link. The connecting link 48 and the crank links 50, 52 are movable toward the throat portion 36 of the terminal.

FIG. 4 shows the connecting means 27 prior to the insertion of the conductor 64. FIG. 5 shows the connecting means 27 after it has been terminated. For purposes of clarity, the conductor has been omitted from this figure. The connecting means 27 is terminated by applying a deforming force to the free end 38 of the first jaw member 32. As the force is applied, the connecting link 48 and the crank links, 50, 52 move toward the throat portion 36 of the terminal. Connecting link 48 also moves laterally toward the second jaw member bringing the first and second jaw members into clamping arrangement with the conductor.

As is shown in FIGS. 3, 4, and 5, in the preferred embodiment, the first jaw member 32 has a plurality of teeth 56 and a flat portion 58 along its lower edge. The teeth 56 are used to skive through insulation such as that found in flat flexible cable, thereby contacting the conductor 64 and ensuring electrical contact with the connecting means 27. The teeth 56 also aid in retaining the conductor carrier 62 in connecting means 27. The flat portion 58 ensures electrical contact when conductors 64 are not covered by insulation, for example, when the conductors 64 are conductive ink. The flat portion 58 provides a compression force to the conductive ink.

Figure 7:
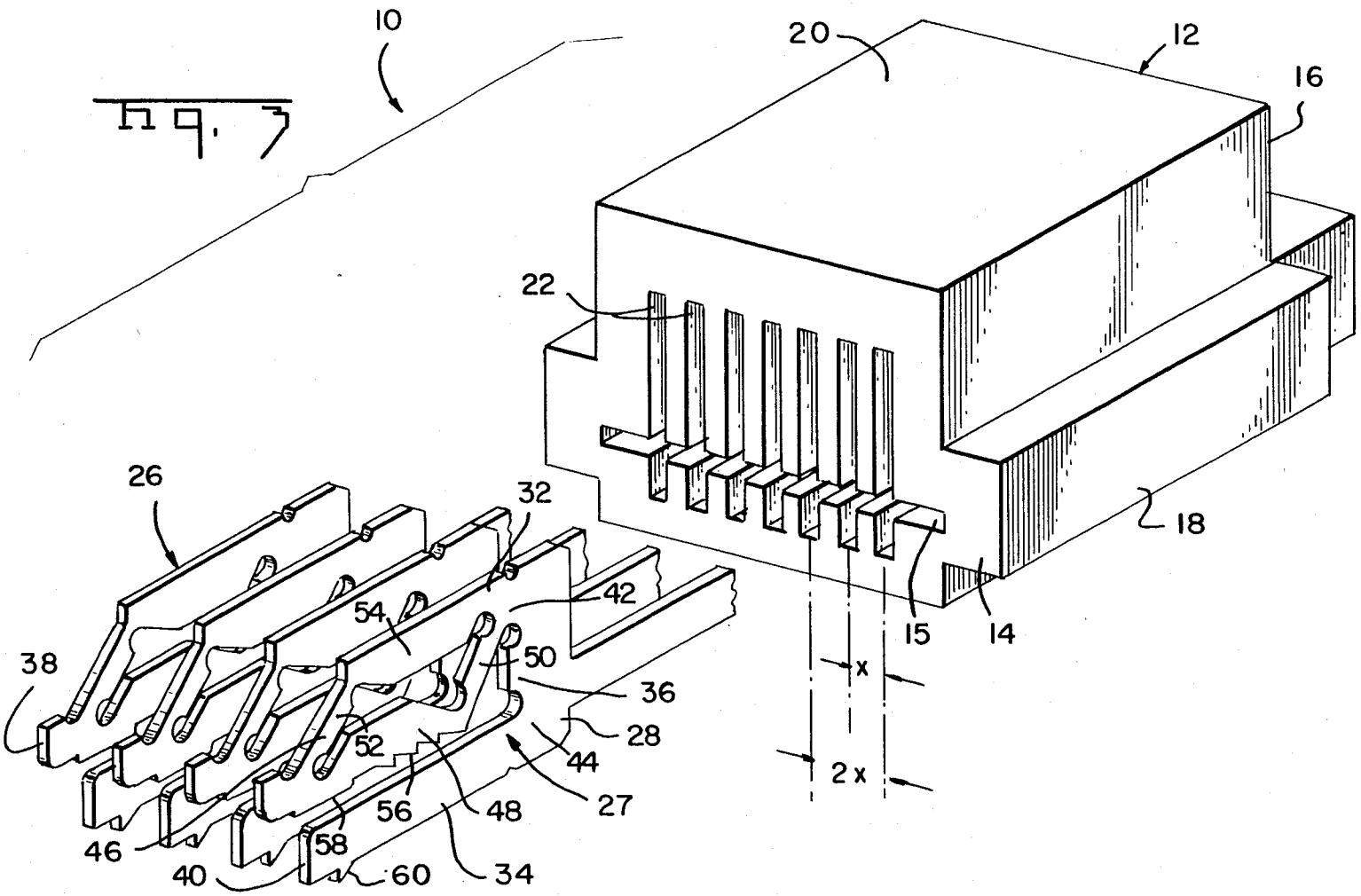
FIG. 7 is a view similar to that of FIG. 6 showing the contact terminal crimped onto the cable conductor.
Figure 6:
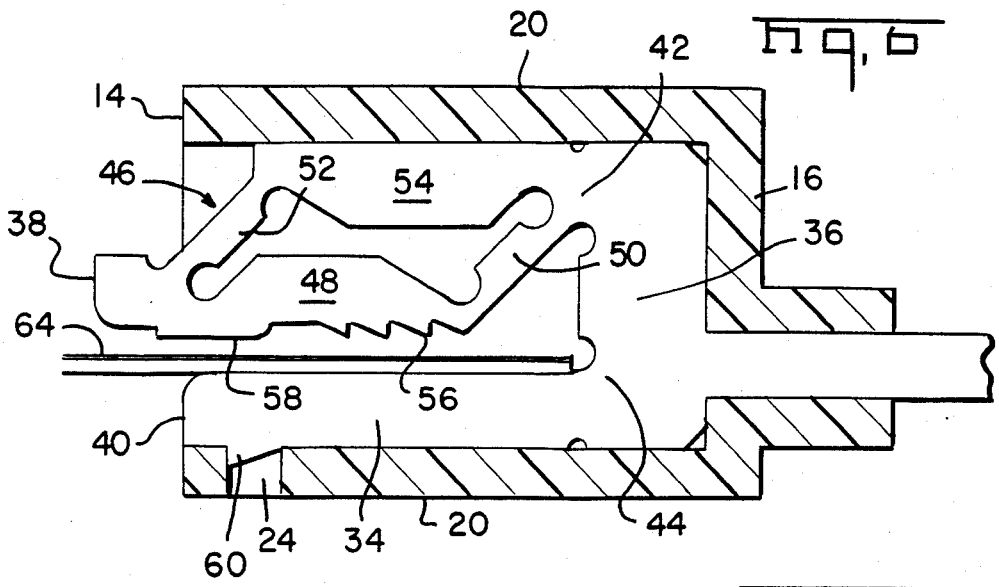
FIG. 6 is a cross sectional view of the preloaded device illustrating placement of the cable into the terminal.
Figure 7:
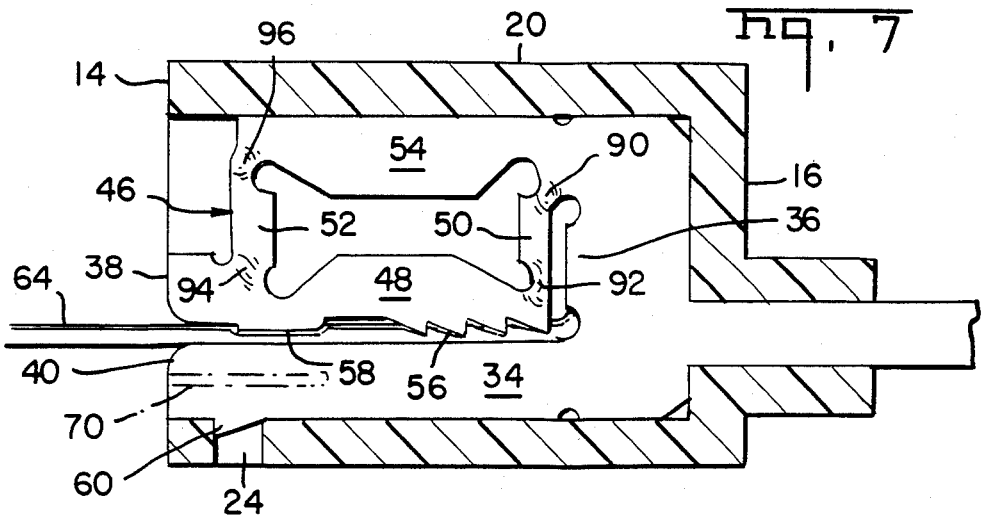

FIGS. 6 and 7 are cross sectional views of the herein disclosed invention. FIG. 6 shows the connecting means 27 in the cavity 22 of the housing 12 prior to termination. FIG. 7 shows the connecting means 27 after it has been terminated. A terminal restraining extension 60 on the lower edge of the second jaw member 34 cooperates with a terminal restraining means 24 in the housing 12, thus holding the terminal 26 inside the housing 12. FIG. 6 also shows an elongated conductor 64 which has been inserted between the first and second jaw members 32, 34.

FIG. 7 shows the connecting means 27 after termination. The teeth 56 have penetrated the conductor 64. Portion 38 of the first jaw member 32 is now flush with the elongated conductor receiving face 14.

FIG. 7 also illustrates an alternative embodiment of the connecting means 27. A slot 70, shown by the dotted line, may be put in the lower jaw 34 to provide extra resiliency in the terminal particularly when thicker conductor carriers 62 are used.

Figure 8:
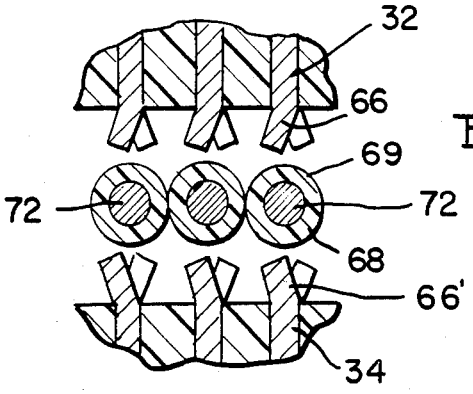
FIG. 8 is a cross sectional view of an alternative embodiment of the terminal for use with flat ribbon cable.

FIG. 8 shows an alternative embodiment in which both jaw members 32, 34 have teeth 66, 66'. The teeth 66, 66' are offset so that the connecting means can be more easily used with a ribbon cable 68. The teeth 66, 66' penetrate the insulation 69 and hold the round wire 72 securely.

The housing and the connecting means 27 of the disclosed invention are designed for flexibility. The design of the housing allows for selective loading of the terminals depending upon the centerline spacing of the conductors. For example, a housing designed to be used with conductors having a 0.025" centerline can also be used with conductors on 0.050" and 0.100" centerlines by inserting the terminals in every other, or every fourth cavity, respectively.

The connecting means also allows for flexibility. The jaw members are designed to establish electrical contact with conductors that are covered with insulation as well as with conductors having an exposed surface. It can be used with flat flexible cable, etched circuitry, and conductive ink circuitry. The connecting means can be used with cables having various thicknesses. By changing the design of the teeth, round ribbon cable can also be terminated with this connector. Increasing the spacing between the first and second jaw members would also permit a permanent edge connector for printed circuit boards.

Referring now to FIG. 5, stored energy is provided by the deflection of jaw members 32, 34. In the preferred embodiment the second jaw member 34 and the connecting link 48 have essentially zero clearance between them after the connecting means 27 has been terminated. Therefore, when the conductor carrier 62 is inserted into connecting means 27, an interference is caused between jaw member 34 and connecting link 48. When the four bar linkage mechanism 46 is closed, connecting link 48 transmits the deflection caused by the interference through the crank links 50, 52 to the first jaw member 34. This deflection provides stored energy in the connector means 27 and provides a constant normal force to be applied to the contact interface.

As is shown in FIG. 5, the four bar linkage mechanism 46 has four controlled bend points, 90, 92, 94 and 96, the first two 90, 92 in crank link 50 and second two 94, 96 in crank link 52. When force is applied to free end 38 of the first jaw member 32, the crank links 50, 52 pass slightly beyond the 90° axes of throat portion 36. The four controlled bend points 90, 92, 94, and 96 plastically yield thereby maintaining the linkage mechanism 46 in a closed position.

It is thought that this connector for closely spaced conductors and many of its attendant advantages will be understood from the foregoing description and it will be apparent that various changes may be made in the form, construction, and arrangement of the parts thereof without departing from the spirit or scope of the invention, or sacrificing the material advantages. The form herein before described is merely a preferred or exemplary embodiment thereof.

What is claimed is:

1. A preloaded electrical connecting device for use with elongated conductors is comprised of an insulating housing having one or more electrical contact terminals therein, the housing having an elongated conductor receiving face, an oppositely facing conductor entry face, oppositely facing parallel sidewalls, and oppositely facing parallel endwalls extending between the faces, and an elongated carrier receiving slot, the slot being essentially parallel to the endwalls and extending rearwardly onto the housing from the elongated conductor receiving face, a plurality of terminal receiving cavities extending through the housing from the elongated conductor receiving face to the conductor entry face essentially parallel to the sidewalls with at least one of the cavities having an electrical contact terminal therein, the device being characterized in that:

each contact terminal is a flat one piece stamped sheet metal member having an elongated conductor connecting means at one end, the connecting means has first and second jaw members and a throat portion, the jaw members having free ends and fixed ends, the fixed ends being spaced from each other and attached to the throat portion, the free ends being spaced from each other, and movable toward each other, the free end of the first jaw member further having a portion that extends outwardly from the elongated conductor receiving face of the housing whereby, upon placing the elongated conductor between the first and second jaw members and applying a deforming force to the free end of the first jaw member, the outwardly extending portion of the first jaw member is moved into the housing until the portion is flush with the front face and the first jaw member is moved into clamping engagement with the conductor and second jaw member, thus establishing electrical contact with the conductor.

2. A preloaded electrical connecting device as recited in claim 1, characterized in that the first jaw member is a four bar linkage mechanism having a fixed link, a connecting link and two crank links.

3. A preloaded electrical connecting device as recited in claim 2, characterized in that at least one of the jaw members has one or more teeth along its clamping edge.

4. A preloaded electrical connector as recited in claim 3, characterized in that the elongated conductors are surrounded by insulation, whereby, as the first jaw member moves into clamping engagement with the conductor and second jaw member, the teeth pierce the insulation thus making electrical contact with the conductor.

5. A preloaded electrical connector as recited in claim 3, wherein the first jaw member further has a flat portion along its lower edge proximate to the free end of the member whereby, the flat portion rests on top of the elongated conductor as the first jaw member is moved into clamping engagement with the conductor and second jaw member.

6. An electrical contact terminal which is applicable to an elongated conductor to establish electrical contact with said conductor, the terminal being characterized in that:

the terminal is a flat one piece stamped sheet metal member having an elongated conductor connecting means at one end, the connecting means has first and second jaw members and a throat portion, the jaw members having free ends and having fixed ends, the fixed ends being spaced from each other and attached to the throat portion, the jaw members and the throat portion being located in a common plane, the first jaw member is comprised of a four bar linkage mechanism, the linkage mechanism being comprised of a connecting link, first and second crank links and a fixed link, the connecting link and fixed link extend essentially parallel to the second jaw member, the crank links join the connecting and fixed links and extend diagonally away from the ends of the connecting and fixed link, the connecting link and crank links being movable toward the throat portion of the terminal with concomitant movement of the connecting link laterally toward the second jaw member upon application of a deforming force to the free end of the first jaw member, whereby, upon placing the conductor between the first and second jaw members and application of the deforming force to the free end of the first jaw member, the connecting link will move against and into clamping engagement with the conductor and the second jaw member and establish electrical contact with the conductor.

* * * * *